US007739884B2

(12) United States Patent
Jeong et al.

(10) Patent No.: US 7,739,884 B2
(45) Date of Patent: Jun. 22, 2010

(54) CONTROL METHOD OF REFRIGERATOR

(75) Inventors: Kyung Han Jeong, Seoul (KR); Il Hyeon Jo, Daejeon (KR)

(73) Assignee: LG Electronics Inc., Seoul (KR)

( * ) Notice: Subject to any disclaimer, the term of this patent is extended or adjusted under 35 U.S.C. 154(b) by 290 days.

(21) Appl. No.: 11/554,231

(22) Filed: Oct. 30, 2006

(65) Prior Publication Data

US 2007/0137240 A1 Jun. 21, 2007

(30) Foreign Application Priority Data

Dec. 16, 2005 (KR) ..... 10-2005-0124877

(51) Int. Cl.
*F25C 1/22* (2006.01)
*F25C 1/00* (2006.01)

(52) U.S. Cl. ..... 62/340; 62/353

(58) Field of Classification Search ..... 62/2, 62/3, 3.63, 3.64, 135, 340, 344, 345, 351, 62/353, 381, 382; 310/62
See application file for complete search history.

(56) References Cited

U.S. PATENT DOCUMENTS

| | | | | |
|---|---|---|---|---|
| 4,587,810 | A | 5/1986 | Fletcher | |
| 4,727,720 | A * | 3/1988 | Wernicki | 62/3.63 |
| 4,852,359 | A | 8/1989 | Mazzotti | |
| 5,182,916 | A * | 2/1993 | Oike et al. | 62/135 |
| 5,763,969 | A * | 6/1998 | Metheny et al. | 310/62 |
| 5,768,900 | A | 6/1998 | Lee | |
| 6,003,318 | A * | 12/1999 | Busick et al. | 62/3.64 |
| 6,438,988 | B1 | 8/2002 | Paskey | |
| 6,481,235 | B2 * | 11/2002 | Kwon | 62/353 |
| 6,735,959 | B1 * | 5/2004 | Najewicz | 62/3.63 |
| 6,865,899 | B2 | 3/2005 | Man et al. | |
| 7,017,354 | B2 | 3/2006 | Lee et al. | |
| 7,021,066 | B2 | 4/2006 | Chung | |
| 7,051,541 | B2 | 5/2006 | Chung et al. | |
| 7,152,424 | B2 | 12/2006 | Shoukyuu et al. | |
| 2005/0126202 | A1 * | 6/2005 | Shoukyuu et al. | 62/351 |
| 2006/0266055 | A1 | 11/2006 | Anderson et al. | |

FOREIGN PATENT DOCUMENTS

CN 2203465 Y 7/1995

(Continued)

OTHER PUBLICATIONS

English Language Abstract of KR 10-2005-0027356.

(Continued)

*Primary Examiner*—Frantz F. Jules
*Assistant Examiner*—Emmanuel Duke
(74) *Attorney, Agent, or Firm*—McKenna Long & Aldridge LLP

(57) ABSTRACT

An ice maker and method for making ice are disclosed. The ice maker includes a compartment, an ice-making tray disposed in the compartment to receive and make ice, and a fan installed on the ice-making tray to make ambient air pass along the surface of the ice-making tray. The method includes selectively supplying chilled air to a compartment according to conditions of the compartment, continuously blowing chilled air in the compartment to an ice-making tray disposed in the compartment regardless of the conditions of the compartment, and distributing blown air on a surface of the ice-making tray uniformly.

19 Claims, 10 Drawing Sheets

FOREIGN PATENT DOCUMENTS

| | | | |
|---|---|---|---|
| CN | 1160173 | A | 9/1997 |
| CN | 1584452 | A | 2/2005 |
| CN | 1590932 | | 3/2005 |
| EP | 1653171 | | 5/2006 |
| JP | 9-079717 | | 3/1997 |
| JP | 2000241052 | | 9/2000 |
| JP | 2005180794 | | 7/2005 |
| KR | 10-0259831 | | 3/2000 |
| KR | 2000-0011264 | | 6/2000 |
| KR | 10-2005-0027356 | | 3/2005 |
| WO | 2005/040698 | A1 | 5/2005 |

OTHER PUBLICATIONS

English Language Abstract of KR 2000-0011264.
English Language Abstract of KR 10-0259831.
U.S. Appl. No. 11/554,252 to Jeong et al., filed Oct. 30, 2006.
English language Abstract of CN 1584452 A.
English language Abstract of CN 2203465 Y.
English language Abstract of DE 19651335.
English language Abstract of WO 2005/040698.

* cited by examiner a : temperature of conventional tray
b : temperature of conventional compartment
A : temperature of present tray
B : temperature of present compartment

CONTROL METHOD OF REFRIGERATOR

This application claims the benefit of Korean Patent Application No. P05-124877, filed on Dec. 16, 2005, which is hereby incorporated by reference as if fully set forth herein.

BACKGROUND OF THE INVENTION

1. Field of the Invention

The present invention relates to a refrigerator, and more particularly, to a method of controlling a refrigerator including an ice maker for making ice using chilled air.

2. Discussion of the Related Art

Generally, a refrigerator is partitioned into a refrigerator compartment and a freezer compartment. The refrigerator compartment is maintained about at 3 degrees centigrade to 4 degrees centigrade such that food and vegetables can be stored in good condition for a long time, and the freezer compartment is maintained under zero degrees centigrade such that meat and other food can be stored at a frozen state.

Recently, the refrigerator includes various features such as an ice maker, a dispenser, or the like. Described in detail, the ice maker automatically performs a series of processes for ice-making without additional manipulations such that a user can conveniently obtain ice. Meanwhile, the dispenser allows the user to obtain ice or cool water at the outside of the refrigerator without opening a door of the refrigerator. FIGS. 1 and 2 illustrate the above-mentioned ice maker equipped in a conventional refrigerator. Hereinafter, the ice maker will be described in detail with reference to the drawings.

The conventional ice maker 10 includes an ice-making tray 11 for forming ice-making compartments in which ice is made, a water supply 12 formed at a side of the ice-making tray 11 to supply water to the ice-making compartments, a heater installed on the lower side of the ice-making tray 11, an ejector 14 for ejecting ice made in the ice-making tray 11 to the exterior, a driving device 13 for driving the ejector 14, and ice bank 20 for receiving and accommodating the ice made in the ice-making tray 11, and an ice-fullness sensor 15 for detecting the quantity of ice accommodated in the ice bank 20.

The water supply 12 is connected to a water source external to the refrigerator and supplies water to the ice-making tray 11 when an ice-making is demanded. The ice-making tray 11 has an approximate semi-circular cross-section and partitions for partitioning the ice-making compartment into several unit cells such that an adequate quantity of predetermined sized ice is made in the ice-making tray 11.

The heater 17, as shown in FIG. 2, is installed on the lower side of the ice-making tray 11 and heats the ice-making tray 11 to melt the ice such that the ice is separated from the ice-making tray 11.

The ejector 14 includes a rotation shaft installed to cross the central area of the ice-making tray 11, and a plurality of ejector pins 14*a* vertically protruded from the rotation shaft. Each of the ejector pins 14*a* is installed to correspond to each unit cell partitioned by the partitions such that the ice in every unit cell is discharged from the ice-making tray 11 when the ejector pins 14*a* rotate.

In the side where the ice is discharged from the ice-making tray 11, a slide 15 is installed in a downwardly oblique state near the rotation shaft of the ejector 14. Thus, the ice discharged from the ice-making tray 11 by the ejector 14 slides on the slide 16, falls down, and is eventually accommodated in the ice bank 20 disposed under the ice maker 10.

The ice-fullness sensor 15 moves up and down by the driving device 13 to check the quantity of the ice contained in the ice bank 20. If the ice bank 20 is full with the ice, the ice-fullness sensor 15 can not move down sufficiently, so that whether or not the ice bank 20 is full is detected by the ice-fullness sensor 15.

The ice maker of the conventional refrigerator freezes water in the ice-making tray using only chilled air that is supplied to the freezer compartment for cooling the freezer compartment. Thus, when temperature of the freezer compartment descends and the chilled air is stopped to supply to the freezer compartment, the speed of making ice in the ice-making tray become slowed. Due to this, the capacity of quantity of ice made per day of the ice maker is deteriorated. Moreover, when a large quantity of ice is required in a short time, the demand cannot be satisfied.

Additionally, in the conventional ice maker of a refrigerator, in order to detect whether or not the ice bank is full, the ice-fullness sensor must be rotated. Thus, since a wide space for the rotation of the ice-fullness sensor should be secured beside the ice-making tray, the size of the ice-making tray must be relatively small so that it is difficult to produce a large quantity of ice.

SUMMARY OF THE INVENTION

Accordingly, present invention is directed to an improved ice-making structure and an ice-making method that substantially obviate one or more problems due to limitations and disadvantages of the related art.

An object of the present invention is to provide an improved ice-making structure for producing a large quantity of ice in a short time and an improved ice-making method.

Another object of the present invention is to provide an improved ice-making structure capable of providing an ice-making speed and a quantity of ice in response to a demand.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an ice maker includes a compartment, an ice-making tray disposed in the compartment to receive and make ice, and a fan installed on the ice-making tray to make ambient air pass along the surface of the ice-making tray. Herein, the fan may be installed on a bottom surface of the ice-making tray.

The ice maker may further include a plurality of passages which are provided on the surface of the ice-making tray to guide air flowed by the fan throughout the ice-making tray. The passages may be arranged from the fan to an edge of the ice-making tray in a radial direction. At least a part of the passages may be bent to prolong a path through which the air passes. The fan may make the air flow substantially perpendicular to the surface of the ice-making tray, and the passages may be arranged such that the air flows substantially parallel to the surface of the ice-making tray.

The ice maker may further include a plurality of fins extended from the ice-making tray to increase the heat-exchange of the ice-making tray with the ambient air. The fins may be arranged such that neighboring fins form a passage through which air blown by the fan passes. The fins may be arranged such that neighboring fins are arranged from the fan to the edge of the ice-making tray in the radial direction. At least a part of the fins may be bent to prolong a path through which the air passes. The fan may make the air flow substantially perpendicular to the surface of the ice-making tray, and the fins may be arranged such that the air flows substantially parallel to the surface of the ice-making tray.

The fan may be driven regardless of conditions of the compartment. A rotation speed of the fan may be varied according to a required ice-making speed or a required quantity of ice. The ice-making tray may rotate to discharge the ice.

In another object of the present invention, an ice maker includes a compartment, a cooling fan for supplying chilled air to the compartment, an ice-making tray disposed in the compartment to receive and make ice, a tray fan provided around the ice-making tray to make ambient air flow along a surface of the ice-making tray, and a plurality of cooling fins extended from the ice-making tray to increase a heat-exchange capacity of the ice-making tray and to guide air, which is flowed by the tray fan, to flow along the surface of the ice-making tray.

In still another object of the present invention, an ice maker includes a compartment, an ice-making tray disposed in the compartment to receive and freeze water, a fan installed on a bottom surface of the ice-making tray, and a plurality of cooling fins extended from the ice-making tray and disposed to guide air, blown by the fan, to an edge of the ice-making tray.

In still another object of the present invention, an ice-making method includes selectively supplying chilled air to a compartment according to conditions of the compartment, continuously blowing chilled air in the compartment to an ice-making tray disposed in the compartment regardless of conditions of the compartment, and distributing blown air on a surface of the ice-making tray uniformly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of a method of controlling a refrigerator and an ice maker, examples of which are illustrated in FIGS. 3 to 10.

Figure 1:
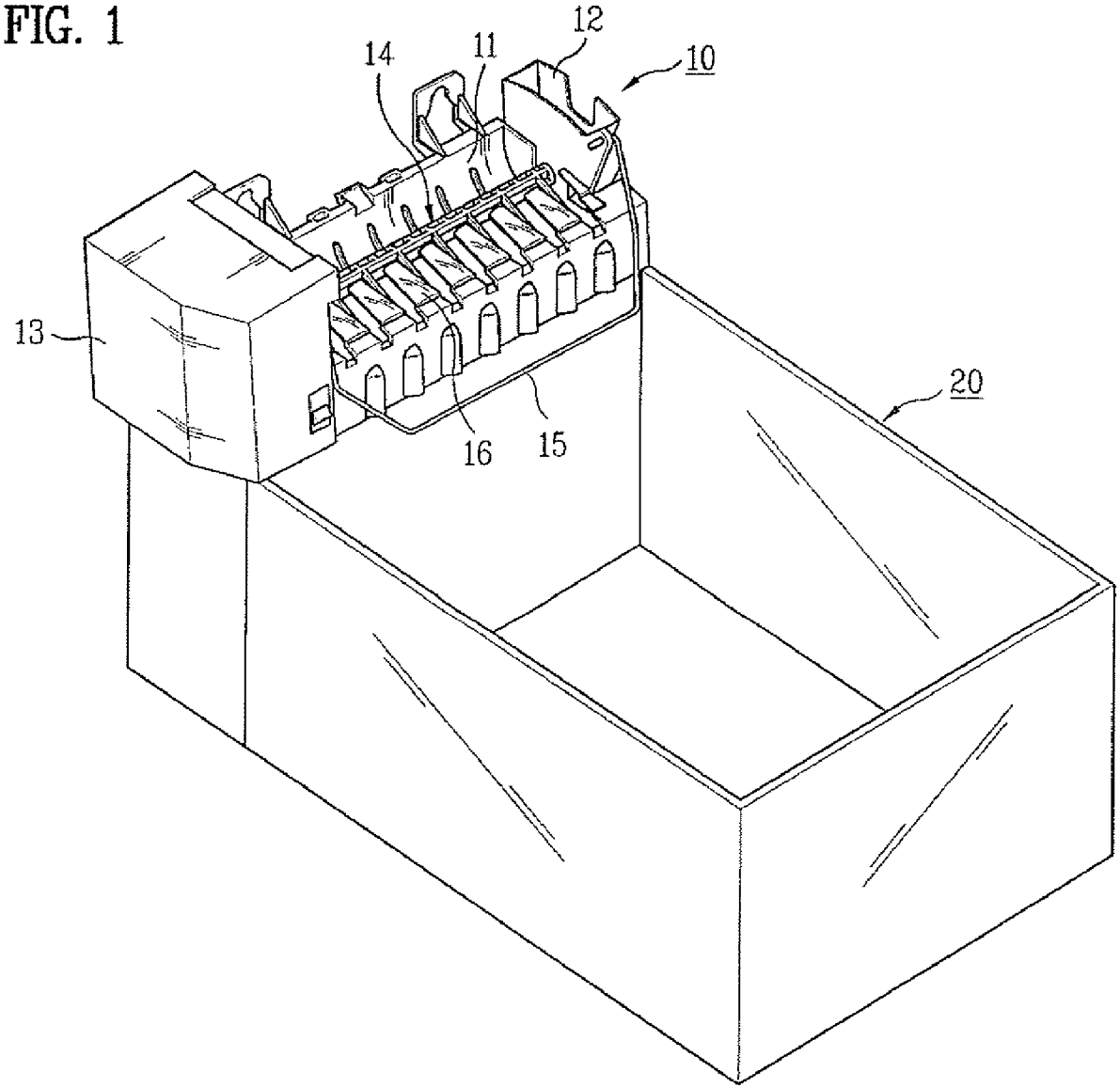
FIG. 1 illustrates a perspective view illustrating a conventional ice maker.
Figure 2:
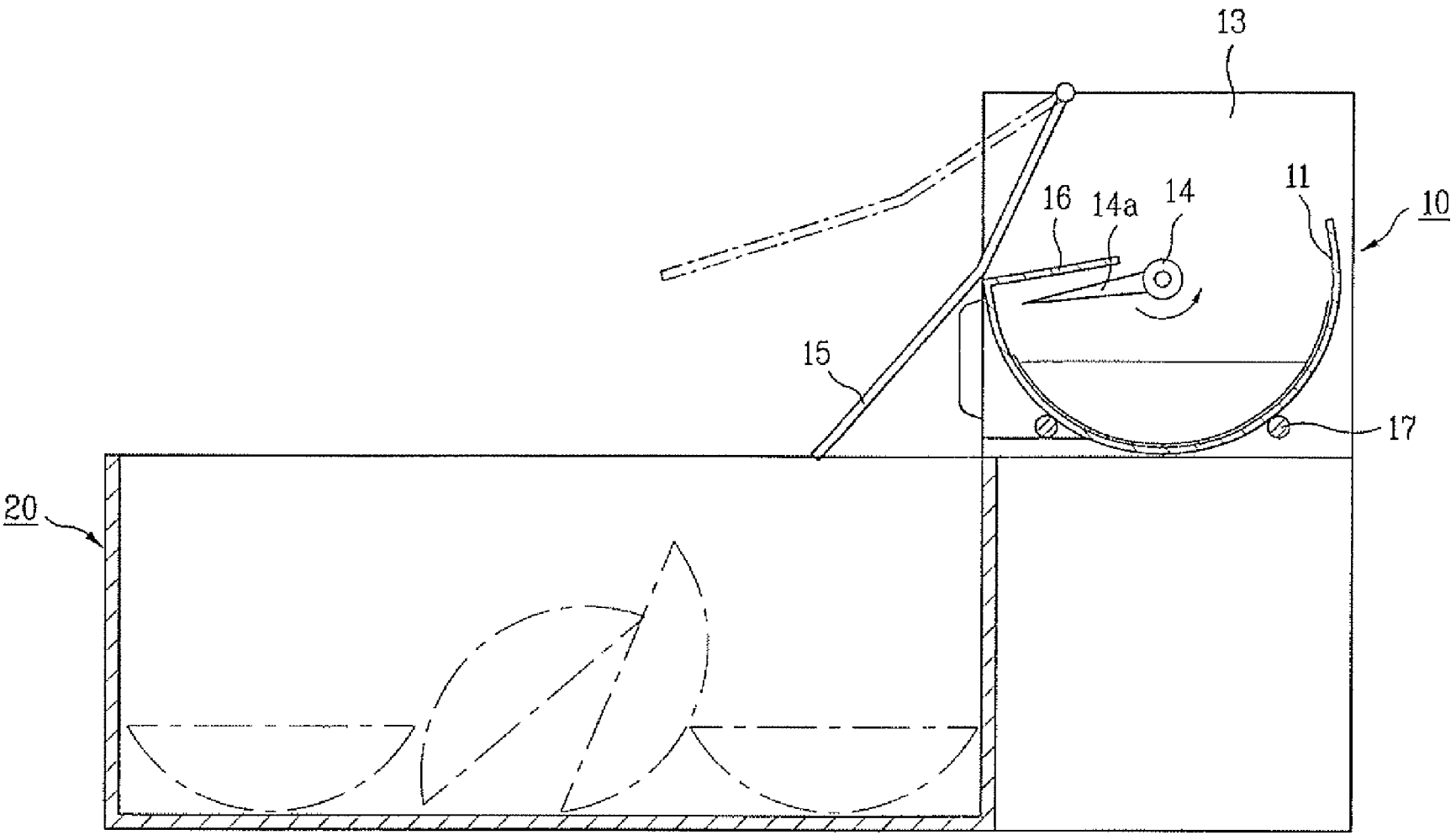
FIG. 2 illustrates a schematic view illustrating operation of the conventional ice maker in FIG. 1.
Figure 3:
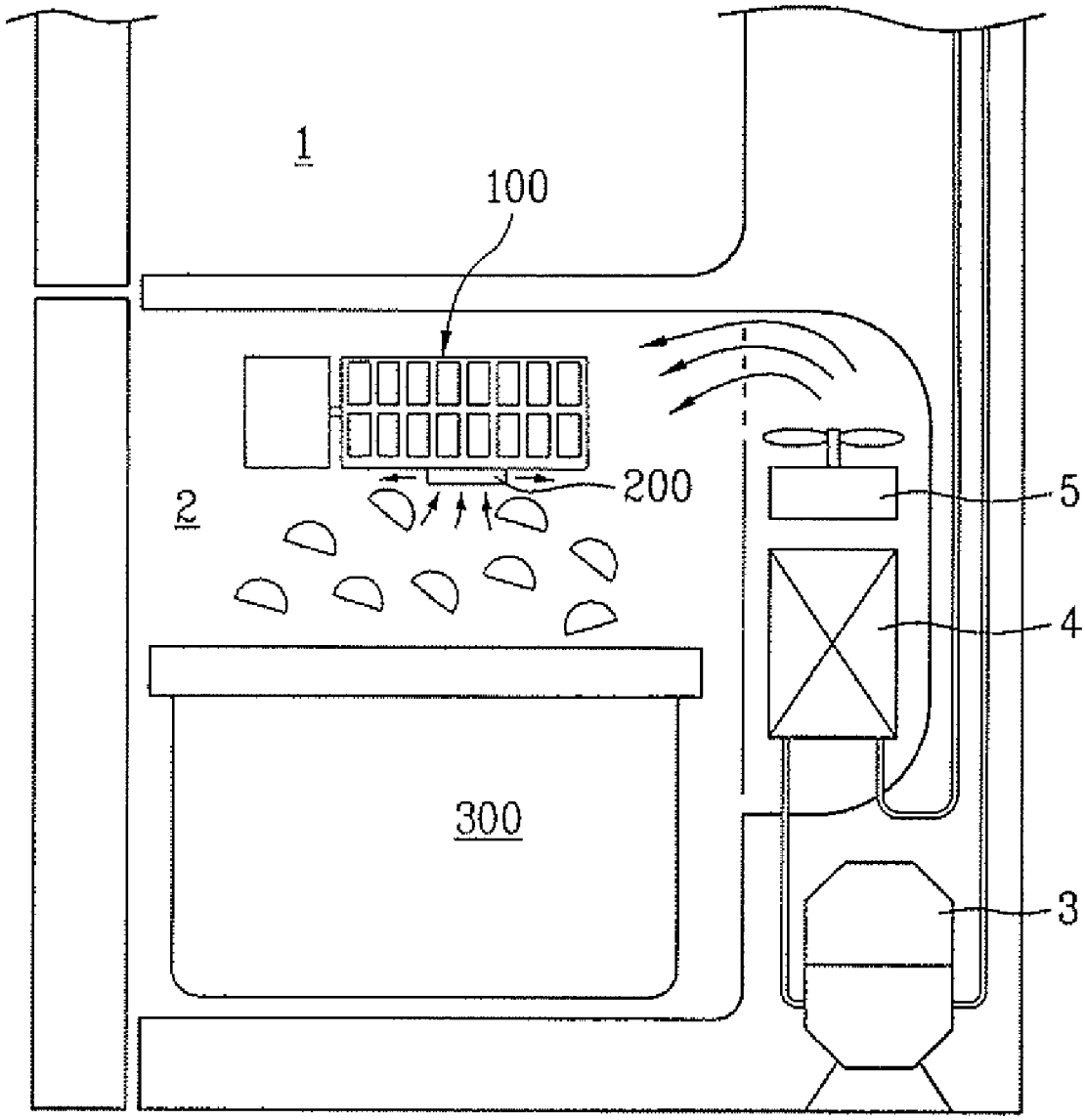
FIG. 3 illustrates a schematic view illustrating a part of a refrigerator according to a preferred embodiment of the present invention.

FIG. 3 schematically shows a refrigerator according to a preferred embodiment of the present invention. The refrigerator according to the preferred embodiment of the present invention includes at least one compartment, for example, a refrigerator compartment 1 and a freezer compartment 2. The refrigerator further includes an evaporator 4, a compressor 3, and a cooling fan 5 for supplying chilled air around the evaporator 4 to the compartments. Here, the compartments may be refrigerated by a single evaporator 4 and a single cooling fan 5, or may be independently refrigerated by a plurality of evaporators and a plurality of cooling fans. In the freezer compartment 2, an ice maker 100 according to the preferred embodiment of the present invention is provided to produce ice. Under the ice maker 100, an ice bank 300 is disposed to receive and accommodate ice produced in the ice maker 100.

The ice maker 100 according to the preferred embodiment of the present invention includes an ice-making tray to be rotated differently from a conventional ice maker. Thus, weight of ice can be used when separating the ice, and due to this, energy required to separate the ice from the ice-making tray can be reduced. In the ice maker 100 according to the preferred embodiment of the present invention, a heat source is provided to apply thermal energy to an interface between the ice and the ice-making tray to effectively help the discharge of the ice during the rotation of the ice-making tray.

Figure 4:
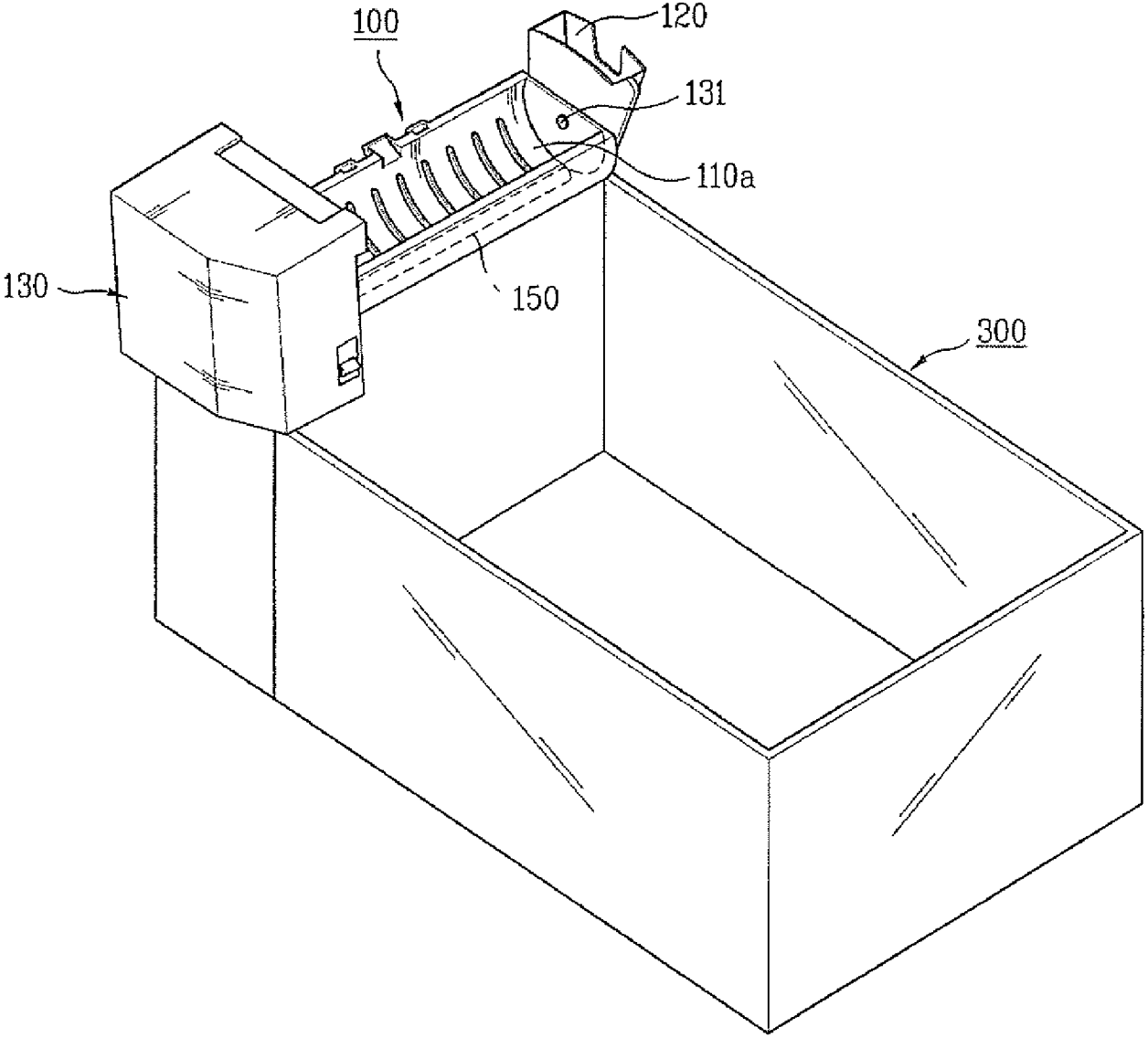
FIG. 4 illustrates a perspective view illustrating an ice maker whose ice-making tray has a single ice-making compartment.
Figure 5:
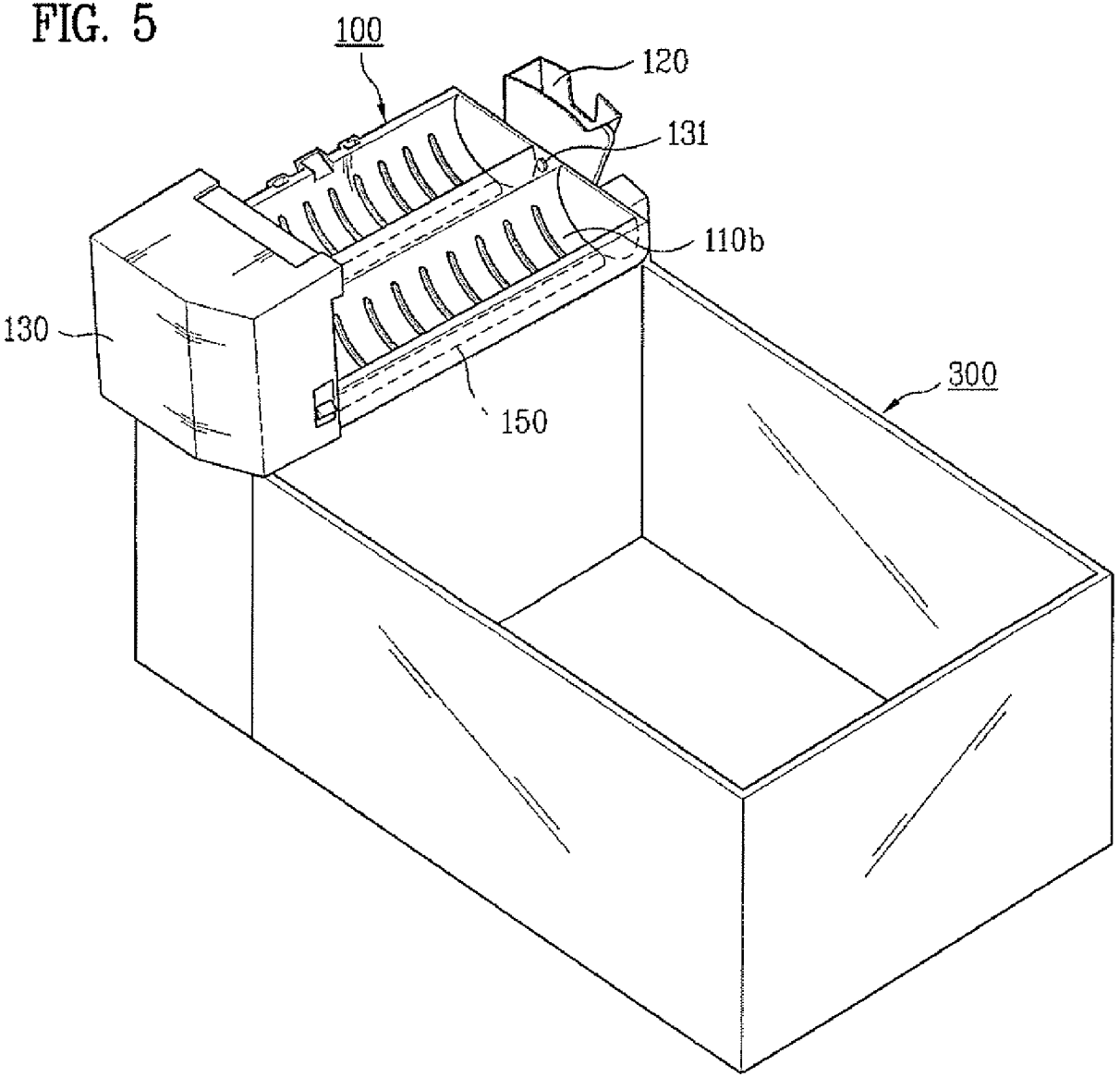
FIG. 5 illustrates a sectional view illustrating an ice maker whose ice-making tray has two parallel ice-making compartments.

As shown in FIG. 4, an ice-making compartment for receiving water and producing ice has a top-opened semi-cylindrical shape. A single ice-making compartment, as shown in FIG. 4, may be provided in a single ice-making tray 110*a*, or dual ice-making compartments, as shown in FIG. 5, may be provided in a single ice-making tray 110*b* in parallel to each other. Naturally, a plurality of the ice-making compartments may be provided in the ice-making tray, or the ice-making compartment may have a shape other than the semi-cylindrical shape.

The ice maker 100 according to the preferred embodiment of the present invention does not include the same components as a conventional ice-fullness sensor requiring a large radius of rotation. Thus, as shown in FIGS. 4 and 5, since a width of the ice-making trays 110*a* and 110*b* (hereinafter referred to as "110") of the ice maker 100 according to the preferred embodiment of the present invention can be much greater than that of the conventional ice maker, a large quantity of ice can be produced at once.

The ice-making compartment is partitioned into a plurality of unit cells by a plurality of partitions which are protruded from the inner circumference of the ice-making tray 110 such that the ice-making tray 110 can produce several pieces of ice at once. In order to smoothly discharge the ice during the rotation of the ice-making tray 110, the respective partitions may be formed long for example in the rotational direction of the ice-making tray 110.

The conventional ice-making tray needs a slide for guiding the ice discharged by the ejector to the ice bank disposed under the ice maker. However, the ice maker 100 according to the preferred embodiment of the present invention discharges the ice in the ice-making tray 110 to the ice bank 300 by rotating the ice-making tray 110. Thus, since the ice-making tray 110 does not need a component corresponding to the slide of the conventional ice-making tray, the structure of the ice-making tray 110 becomes simple.

At a side of the ice-making tray 110, a water supply 120 is provided to supply water to the ice-making compartment. The water supply 120 is connected to an external water source and supplies a predetermined amount of water to the ice-making compartment when the ice in the ice-making tray 110 is separated and the ice-making is required again.

The ice-making tray 110, for example as shown in FIGS. 4 and 5, is installed to rotate about a driving shaft 131 disposed at the center thereof. However, the installation is not limited to the above-mentioned method, but the ice-making tray 110 may be installed to rotate about a shaft disposed at a side of the ice-making tray 110. When the shaft of the ice-making tray 110 is disposed at a side of the ice-making tray 110, the radius of rotation of the ice-making tray 110 is increased.

In order to rotate the ice-making tray 110, a driving device 130 is provided at a side of the ice-making tray 110. The driving device 130 includes a motor (not shown) connected to the driving shaft 131. The driving device 130 may be structured to rotate the ice-making tray 110 forward and reversely or to continuously rotate in a direction.

In order to prevent wiring for connecting the components, which are installed at the ice-making tray 110 to rotate the ice-making tray 110, to the driving device 130 from tangling, the motor of the driving device 130 is preferably rotated forward and reversely. The driving device 130 may be a step motor capable of rotating the ice-making tray 110 forward and reversely by a predetermined angle such as 180 degrees or 90 degrees.

The ice-making tray 110 is detachably connected to the driving device 130. By doing so, it is possible to install an ice-making tray having various shapes and ice-making capacities. Thus, a user can satisfy his/her requirements and can properly adjust an amount of ice produced at once.

As described above, the ice maker 100 according to the preferred embodiment of the present invention may include a heater 150 for supplying thermal energy to an interface between the ice and the ice-making tray 110 for assisting the separation of ice. The heater may be installed to the ice-making tray 110 to physically contact thereto, or to be spaced apart from the ice-making tray 110. For the reference, FIGS. 4 to 8 show an example of the heater 150 crossing the bottom of the ice-making tray 110.

However, the installation of the heater 150 is not limited to the above-mentioned case. As another case, the heater 150 may be disposed at a side of the ice-making tray 110, for example, to surround the bottom of the ice-making tray 110. In this case, the heater 150 may be implemented by a conductive polymer, a plate heater with positive thermal coefficient, an aluminum thin film, or other thermally conductive material. Moreover, the heater 150 is installed on the ice-making tray 110 or an inner surface of the ice-making tray 110. Further, at least a part of the ice-making tray 110 may be made of a resistant body capable of emitting heat when electricity is applied to serve as a heater.

Meanwhile, the ice maker 100 may include a heat source different from the heater and spaced apart from the ice-making tray 110. For example of the heat source, the ice maker 100 may include a light source for emitting light to at least one of the ice and the ice-making tray 110 or a magnetron for emitting microwaves to at least one of the ice and the ice-making tray 110.

The heat source, such as the heater, the light source, or the magnetron as described above, applies heat directly to at least one of the ice or the ice-making tray 110 or the interface therebetween to slightly melt at least a part of the interface between the ice and the ice-making tray 110. By doing so, when the ice-making tray 110 rotates, the ice is separated from the ice-making tray 110 due to own weight even when entire interface is not melted.

Thus, according to the present invention, since the ice can be separated only by supplying a small amount of energy, less than that supplied by the conventional ice maker, the energy consumption can be reduced. Naturally, since a small quantity of ice is melted, a small amount of water is produced when separating the ice so that water can be effectively prevented from falling from the ice-making tray 110 to the ice bank 300.

Meanwhile, when the heat source is disposed to heat the ice-making tray 110, the ice-making tray 110 is gradually heated so that the interface between the ice and the ice-making tray 110 is melted. However, at a place of the interface adjacent to the heat source, a large quantity of ice melts rapidly, but at a place farther away from the heat source, a small quantity of ice melts slowly. Thus, even when the ice-making tray 110 is turned over to separate the ice using the weight of the ice, it is difficult to completely prevent an excessive local ice-melting at the interface.

Thus, in order to effectively prevent water from falling due to the excessive melting of the ice during the rotation of the ice-making tray 110, it is preferred to properly control the quantity and time of the thermal energy to be supplied to the interface between the ice and the ice-making tray 110.

To this end, the present invention gives a proposal to supply high level energy to the interface between ice and the ice-making tray 110 within a very short time. For example, when a high voltage is applied to the heater 150 for heating the ice-making tray 110 instantaneously, the heater 150 emits a high temperature heat instantaneously so that the ice-making tray 110 is also heated promptly to partially melt the interface between ice and the ice-making tray 110. At this time, if the ice-making tray 110 is already rotated or is rotating, the ice is separated from the ice-making tray 110 due to own weight of the ice before the interface melts in local and excessive. Thus, it is possible to effectively prevent water from dropping during the rotation of the ice-making tray 110 due to the excessive melting of the ice.

When the high leveled thermal energy is applied to the interface between ice and the ice-making tray 110 within a short time, it is possible to separate the ice from the ice-making tray 110 using only a minimal quantity of melted ice required for the ice-separation using the weight of ice. However, when time for supplying thermal energy is not properly controlled, the ice-making tray 110 is overheated even after the discharge of ice so that excessive power consumption and heat loss may occur.

Thus, the time for supplying thermal energy is preferably restricted by a time when a force due to the weight of ice begins to exceed the bonding force between ice and the ice-making tray 110. In other words, although entire interface between ice and the ice-making tray 110 does not melt, the time for supplying thermal energy is restricted by the time when the ice starts to be separated by the force due the weight of ice.

To this end, the heat source is controlled to supply thermal energy for an optimal time for supplying thermal energy obtained from experiments, or it is possible to control the time for supplying thermal energy by detecting variation of weight of the ice-making tray 110. As such, when the time for supplying high-level thermal energy to the interface between ice and the ice-making tray 110 is controlled within a very short time, since it is possible to obtain the minimal quantity of melted ice required to separate the ice using the weight of the ice, it is possible to effectively prevent water from dropping during the rotation of the ice-making tray 110 due to the excessive melting of ice. Naturally, heat loss and excessive power consumption are also prevented.

Meanwhile, the ice maker 100 according to the preferred embodiment of the present invention detects whether or not the ice bank 300 is full when the ice-making tray 110 rotates. Described in more detail, if the ice-making tray 110 smoothly rotates without disturbance by the ice in the ice bank 300, the ice maker 100 detects that the ice bank 300 is not full. If the ice-making tray 110 does not smoothly rotate due to the ice in the ice bank 300, the ice maker 100 detects that the ice bank 300 is full.

To this end, for example a magnetron is installed to the rotatable ice-making tray 110, and another component, for example, a hall sensor may be installed to a fixed plate (not shown) in the driving device 130 to correspond to the magnetron. By doing so, as the ice-making tray 110 rotates, relative position of the hall sensor with respect to the magnetron is changed so that whether or not the ice bank 300 is full can be determined based on the intensity of an output voltage from the hall sensor.

In more detail, for example, when the ice bank 300 is full with ice, the ice-making tray 110 cannot rotate forward to separate ice or to return to the initial position after the separation of ice. Then, since the ice-making tray 110 stops rotating and a magnetic force of a magnet does not affect the hall sensor, it is possible to detect whether or not the ice bank 300 is full based on voltage outputted from the hall sensor.

It is possible to determine whether ice-making is finished or not using a time for making ice or temperature of the ice-making tray 110. For example, it is possible to determine that the ice-making is finished when a predetermined time passes after supplying water, or when temperature measured by a temperature sensor (not shown) installed at the ice-making tray 110 is lower than a predetermined temperature, for example, approximately −9 degrees centigrade.

Figure 6:
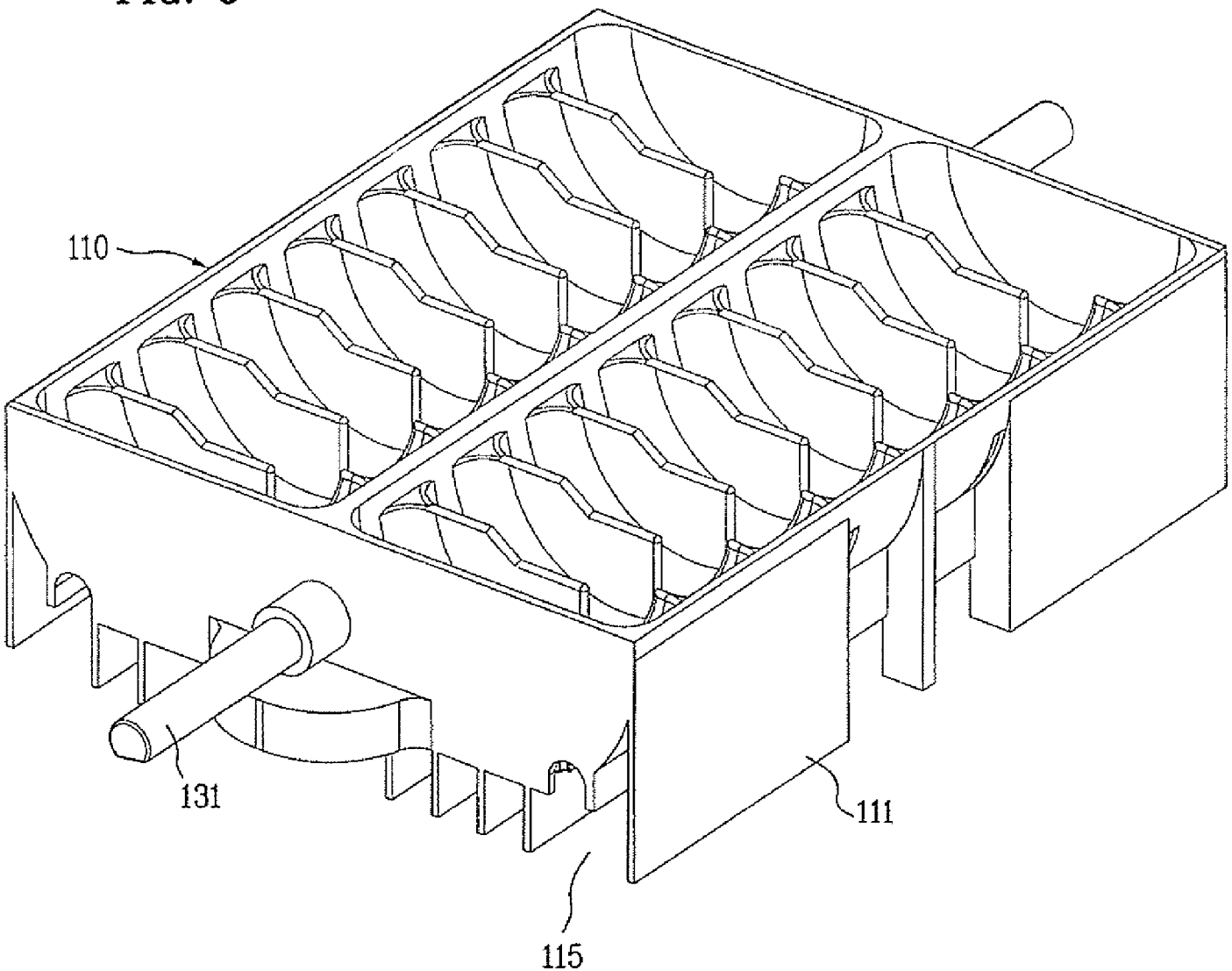
FIG. 6 illustrates a perspective view illustrating the ice-making tray of the ice maker according to the preferred embodiment of the present invention.
Figure 7:
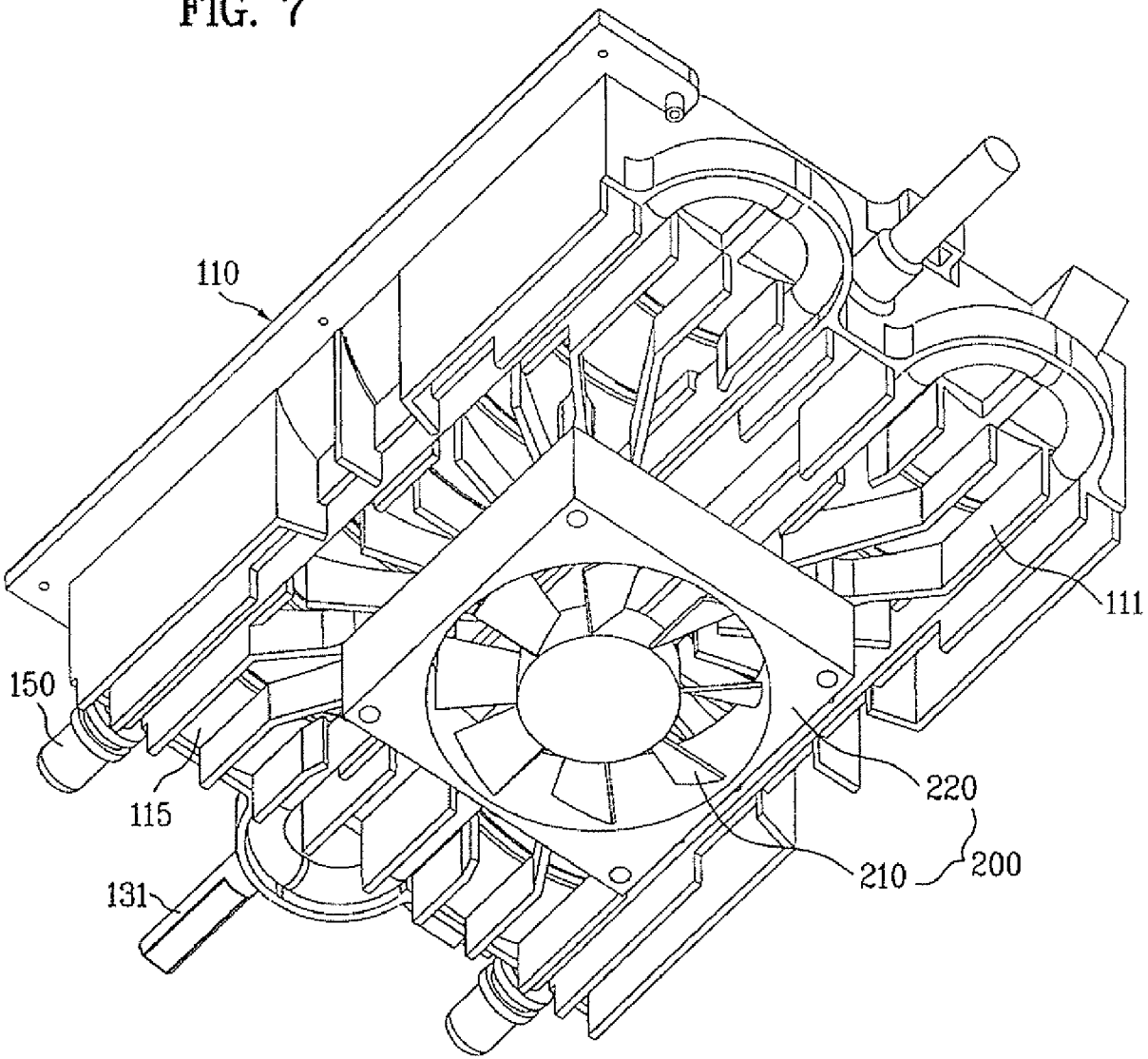
FIG. 7 illustrates a bottom perspective view illustrating a lower side of the ice-making tray in FIG. 6.
Figure 8:
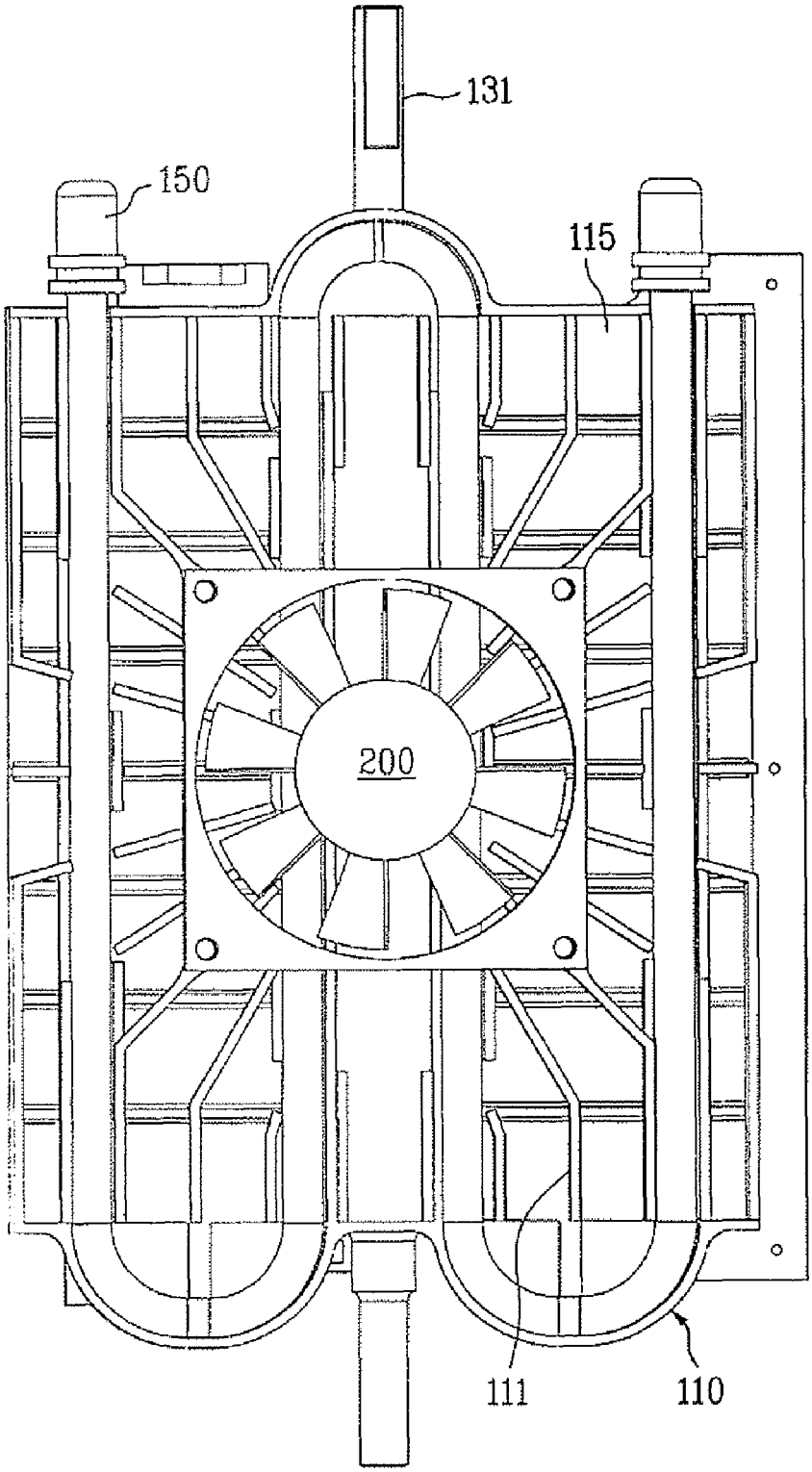
FIG. 8 illustrates a bottom view illustrating the ice-making tray in FIG. 6.

Meanwhile, as described above, the conventional ice maker produces ice using only chilled air blown to the freezer compartment 2 by the cooling fan 5. Thus, if temperature of the freezer compartment 2 is low and thereby the cooling fan 5 stops, refrigerating speed of the ice-making tray 110 is deteriorated. Thus, the present invention proposes a solution for minimizing deterioration of refrigerating speed with respect to variations of condition in the freezer compartment 2 and for improving the ice-making speed. FIGS. 6 to 8 show the ice-making tray 110 according to the preferred embodiment of the present invention, and hereinafter the ice-making tray 110 will be described in detail with reference to the drawings.

As shown in FIG. 6, the ice-making tray 110 has a plurality of ice-making compartments arranged parallel to each other to produce a large quantity of ice at once. The ice-making compartments are partitioned into plurality of unit cells by a plurality of partitions. Since the partitions have cut-off parts or opening parts to communicate the unit cells with adjacent other unit cells, when water is supplied to any one of the unit cells by the water supply 120, the water is uniformly supplied to all unit cells.

The ice maker 100 according to the preferred embodiment of the present invention includes a tray fan 200 which is disposed around the ice-making tray 110 to make ambient air around the ice-making tray 110 flow toward the surface of the ice-making tray 110, independently from the cooling fan 5 for refrigerating the freezer compartment 2. The tray fan 200 continuously supplies ambient air to the ice-making tray 110 to refrigerate the ice-making tray 110 during the operation of the refrigerator, for example, regardless of the condition in the freezer compartment 2 and the operation of the cooling fan 5.

The tray fan 200, as shown in FIG. 7, has a very simple structure including a plurality of blades 210 to rotate and a shroud for enclosing the blades 210. The tray fan 200 is installed on, for example, a surface of the ice-making tray 110, particularly, on a bottom surface of the ice-making tray 110 as shown in FIGS. 7 and 8. By doing so, since the ice-making tray 110 and the tray fan 200 can be made into a single assembly, the ice maker has a simple structure and productivity thereof is improved.

According to the above-mentioned ice maker of the present invention, since the tray fan 200 continuously supplies chilled air in the compartment to the ice-making 110, the ice-making speed is greater than that of the conventional ice maker. Due to this, the capacity of making ice per unit time and the capacity of quantity of ice made per day are remarkably improved. The present invention is not limited to this, but suggests an ice maker for improving the ice-making speed further.

To this end, on the surface of the ice-making tray 110, a plurality of passages 115 is provided to guide air flowed by the tray fan 200 to every position of the surface of the ice-making tray 110. Thus, chilled air blown by the tray fan 200 is uniformly distributed on the surface of the ice-making tray 110 due to the passages 115 so that the refrigerating speed of the try fan 200 is further increased.

The passages 115, as shown in FIGS. 7 and 8, are arranged from the tray fan 200 to the edge of the ice-making tray 110 in the radial direction, and at least a part of them may be bent to prolong flow paths of air. When the plurality of passages 115 is formed on the surface of the ice-making tray 110 as described above, chilled air, which is blown substantially perpendicular to the surface of the ice-making tray 110 by the tray fan 200, flows to the surface of the ice-making tray 110 horizontally to refrigerate the ice-making tray 110 uniformly.

In order to improve the capacity of the ice-making tray 110 for performing heat-exchange with ambient air, on the surface of the ice-making tray 110, a plurality of cooling fins 111 may be extended. The cooling fins 111, as shown in FIGS. 7 and 8, are preferably arranged such that neighboring fins form the passages 115. Thus, the cooling fins 111 are arranged from the tray fan 200 to the edge of the ice-making tray 110 in the radial direction, and some of the fins 111 are bent to prolong the passages 115.

According to the ice maker as described above, apart from that the cooling fan 5 selectively supplies chilled air the compartments based on the conditions of the compartments, the tray fan 200 continuously supplies chilled air to the ice-making tray 110 disposed in the compartment regardless of the conditions of the compartment, and the passages 115 distribute air flowed by the tray fan 200 to the surface of the ice-making tray 110. Thus, the ice-making speed is remarkably increased. This can be easily confirmed from the graph in FIG. 9, and hereinafter the graph will be described in brief.

Figure 9:
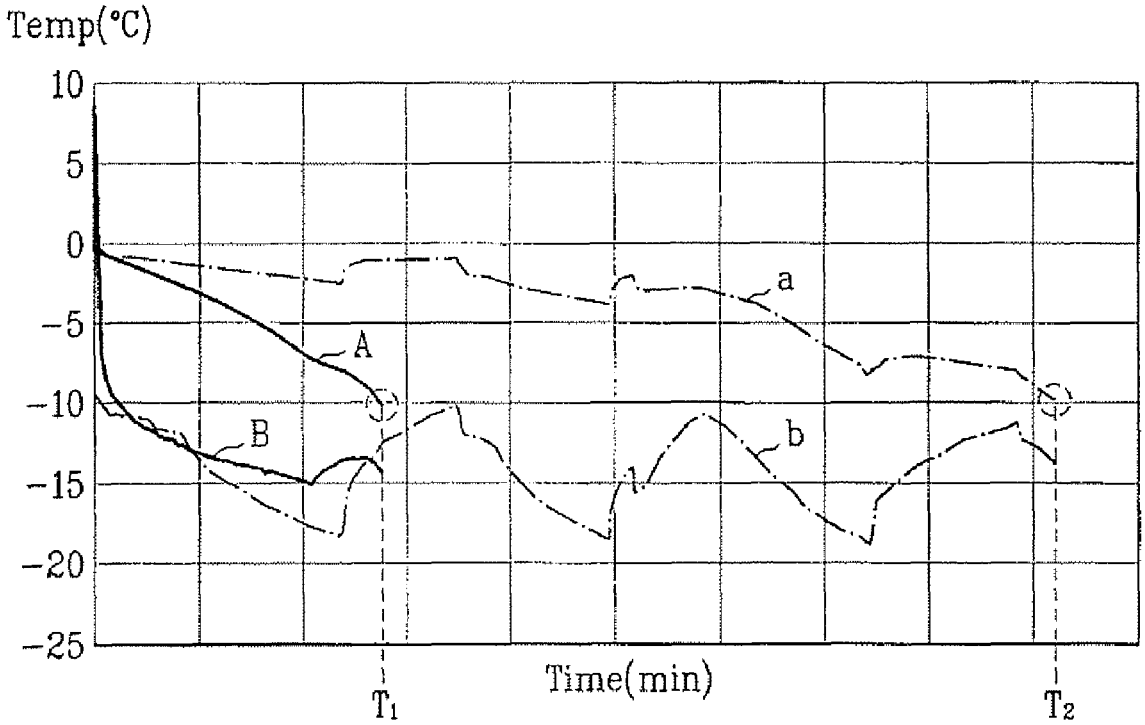
FIG. 9 illustrates a graph illustrating the comparison of temperatures in the ice-making trays and the refrigerator compartments of the conventional ice maker and the ice maker according to the preferred embodiment of the present invention at regions where water in the ice-making tray is changed in phase.

FIG. 9 is a graph illustrating the comparison of temperatures in the ice-making trays and the refrigerator compartments of the conventional ice maker and the ice maker according to the preferred embodiment of the present invention at regions where water in the ice-making tray is changed in phase.

Since the cooling fan of the conventional ice maker is driven intermittently, temperature b of the compartment, as shown in FIG. 9, repeatedly rises and falls in a periodic cycle while water in the ice-making tray is frozen during the phase change. Thus, until water in the ice-making tray is completely frozen due to the phase change, temperature a of the ice-making tray 110 gradually falls for a long time T2 while repeatedly rising and falling together with the temperature b of the compartment.

On the other hand, in the ice maker 100 according to the preferred embodiment of the present invention, the tray fan 200 continuously blows chilled air in the compartment toward the ice-making tray 110 regardless of the conditions of the compartment and the operation of the cooling fan 5. Thus, temperature A of the ice-making tray 110 is hardly affected by the temperature B of the compartment and rapidly falls for a short time T1.

As the graph shows, according to the ice maker of the present invention, since the capacity of the ice-making tray 110 for performing heat-exchange is remarkably improved, the capacity of making ice and the ice-making speed of the ice maker of the present invention is improved more than three times that of the conventional ice maker.

Figure 10:
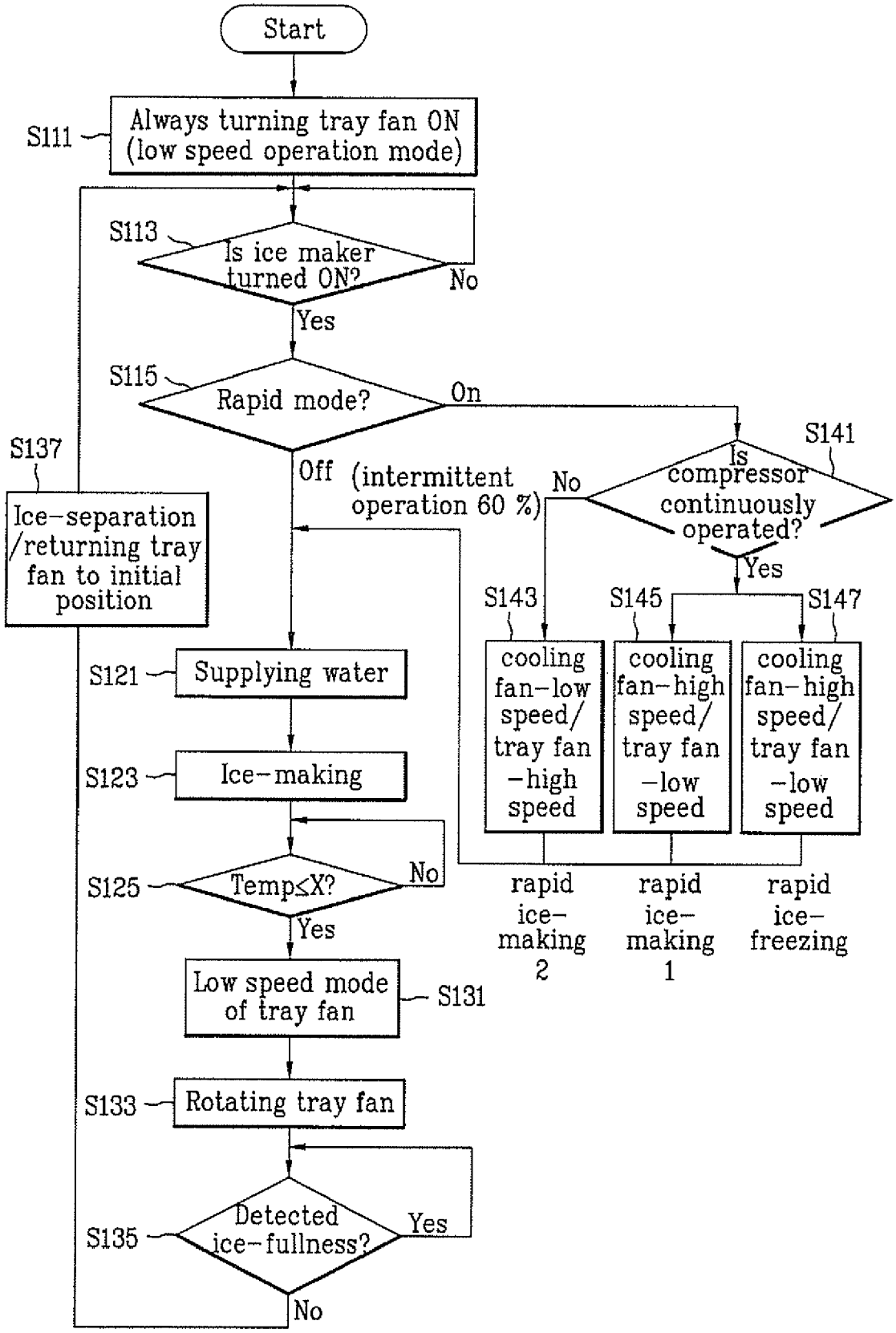
FIG. 10 illustrates a flowchart illustrating a method of controlling a refrigerator according to a preferred embodiment of the present invention.

Meanwhile, the ice maker 100 of the present invention provides a solution of improving the ice-making speed and capacity as well as of varying the ice-making speed and the quantity of ice in response to demand of users. To this end, the tray fan 200 is constructed to vary the rotation speed thereof in response to the demand, and the present invention provides a method of controlling a refrigerator using the ice maker. FIG. 10 is a flowchart illustrating the method of controlling a refrigerator according to a preferred embodiment of the present invention. Hereinafter, the method of controlling a refrigerator will be described in detail.

The cooling fan 5 is intermittently driven according to the conditions of the compartment to supply chilled air to the compartment. On the contrary, the tray fan 200 always rotates regardless of the conditions of the compartment and the operation of the cooling fan 5 in order to blow chilled air in the compartment to the ice-making tray 110 disposed in the compartment (S111). Here, the tray fan 200 basically rotates at a low speed. Moreover, chilled air blown from the ice-making tray 110, as described above, is uniformly distributed to the outer surface of the ice-making tray 110 due to the cooling fins 111 and the passages 115.

When there is no demand for making ice and the ice maker 100 is turned off, the ice-making is not performed. However, when the demand for making ice and the ice maker 100 is turned on, the ice-making starts (S113). When the ice-making starts, a controller determines whether or not rapid mode buttons separately provided on an outer surface of the refrigerator are pressed by a user (S115). According to the determination, the rotation speed of the tray fan 200 is varied. If necessary, the rotation speed of the cooling fan 5 and operation rate of the compressor 3, that is, operation time of the compressor per unit time is varied to perform the rapid mode or a usual mode selectively.

The rapid mode is provided to rapidly refrigerate food accommodated in the freezer compartment or to increase the ice-making speed and the quantity of ice when the user demands. When the rapid mode buttons are pressed, the rapid mode is carried out, and when the rapid mode buttons are not pressed, the usual mode is carried out.

Meanwhile, the operation mode of the refrigerator may include, for example, three-stepped mode or four-stepped mode containing the rapid mode and the usual mode. When the operation mode is the three-stepped mode, the rapid mode includes a rapid freezing mode (S147) of rapidly freezing food in the compartment, and a first rapid ice-making mode (S145) of rapidly increasing the ice-making and the quantity of ice. When the operation mode is the four-stepped mode, the rapid mode further includes a second rapid ice-making mode (S143) of slightly increasing the ice-making and the quantity of ice.

The rapid mode buttons include buttons corresponding to the respective modes. Thus, the user can manipulate the rapid mode buttons to control the desired freezing speed, the desired ice-making speed, and the desired quantity of ice. Hereinafter, how to control the ice-making tray 110, the cooling fan 5, and the compressor 3 will be described in detail with reference to FIG. 10.

Firstly, when any one of the rapid mode buttons is not pressed, the refrigerator performs the usual mode. When the ice-making is carried out under the usual mode, the water supply 120 supplies water to the ice-making compartments of the ice-making tray 110 (S121). When the supply of water is finished, water in the ice-making tray 110 is exposed to chilled air in the compartment for a predetermined time and is frozen (S123). During the ice-making, the tray fan 200 continuously rotates at a low speed, the cooling fan 5 intermittently rotates according to the conditions of the freezer compartment 2. Simultaneously, the compressor 3 is intermittently driven at 60% operation rate.

When temperature of the ice-making tray 110 falls under a predetermined temperature or a predetermined time elapses after the supply of water, it is determined that the ice-making is finished (S125) and a process of separating ice is performed or the ice-making is continued. When the ice-making is finished, in order to separate ice, the tray fan 200 rotates at a low speed (S131) and the ice-making tray 110 is rotated (S133).

The ice-making tray 110 detects whether or not the ice bank 300 is full as described above during the rotation of the ice-making tray 110 (S135). If the ice bank 300 is full, the ice-making tray 110 rotates reversely and returns to the initial position. If not, the ice-making tray 110 rotates to an ice-separation position. In order to obtain the minimal quantity of melted ice required to separate ice using weight of ice, a high-leveled thermal energy is supplied to the interface between ice and the ice-making tray 110 within a short time so as to separate ice (S137). At this time, the time for supplying thermal energy of the heat source is restricted by time before water drops from the ice-making tray 110 due to the excessive melting. Although the ice-separation is finished, since the minimal quantity of ice required to separate ice is melted, water in the ice-making tray 110 does not fall from the ice-making tray 110 due to the surface tension thereof.

Ice separated from the ice-making tray 110 is accommodated in the ice bank 300. When the ice-separation is finished, the ice-making tray 110 rotates reversely and returns to the initial position (S137). If the ice maker 100 is turned off, the ice-making stops until the ice maker 100 is turned on. When the ice maker 100 is turned on, the above-mentioned processes are repeated.

Meanwhile, on the other hand, when the ice-making tray 110 returns after the ice-separation, it is possible to detect whether or not the ice bank 300 is full. In this case, when the ice bank 300 is not full, the ice-making tray 110 returns to the initial position. However, when the ice maker 100 is not turned off and the demand for making ice is continued, the ice maker 100 waits for a predetermined time. After the predetermined time elapsed, the ice-making tray 110 rotates to detect whether or not the ice bank 300 is full. According to the detection, the above-mentioned processes are performed.

Meanwhile, when the rapid mode buttons are pressed, whether or not to increase the operation rate of the compressor 3, for example, to continuously operate the compressor 3 is determined. When the rapid freezing mode (S147) is selected, the cooling fan 5 rotates at high speed and the tray fan 200 rotates at low speed while the compressor 3 is continuously operated. By doing so, chilled air in the freezer compartment 2 is not used to be supplied to the ice-making tray 110 and to freeze water in the ice-making tray 110, but greater quantity of chilled air is used to freeze food in the freezer compartment 2. This mode is useful to rapidly freeze food in the freezer compartment 2.

When the first rapid ice-making mode (S145) is selected, the cooling fan 5 and the tray fan 200 rotate at high speed while the compressor 3 is continuously operated. Then, the compartment is rapidly refrigerated and the water in the ice-making tray 110 is also rapidly frozen. This mode is useful to need a considerable quantity of ice within a short time.

When the second rapid freezing mode (S145) is selected, the cooling fan 5 rotates at low speed and the tray fan 200 rotates at high speed while the compressor 3 is intermittently operated like the usual mode. Then, water in the ice-making tray 110 is rapidly frozen. This mode is useful to want a little large quantity of ice without freezing food in the freezer compartment 2.

When the rapid mode is selected as described above, the refrigerator of the present invention varies the operation rate of the compressor 3, the rotation speed of the cooling fan 5 and the tray fan 200 to provide the rapid freezing service to the user as the user desires. When the rapid mode is selected and controlling type of the compressor 3, the cooling fan 5, and the tray fan 200 is determined, as shown in FIG. 10, the processes such as the supply of water, the ice-making, the detection of ice-fullness, and the ice-separation are performed as described above.

As described above, according to the ice maker of the present invention, since the ice-making tray is rapidly frozen, a large quantity of ice can be produced within a short time. In response to the user's demand, the ice-making speed and the quantity of ice can be varied.

Additionally, according to the present invention, since the structure of the ice-making tray and the structure needed to detect the fullness of ice are simple, it is easy to manufacture and manufacturing costs can be reduced.

Further, since a lot of energy is supplied to the interface between ice and the ice-making tray for a short time, the minimal quantity of melted ice required to separate ice can be obtained. Thus, it is possible to prevent excessive melting and water from dropping during the rotation of the ice-making tray.

It will be apparent to those skilled in the art that various modifications and variations can be made in the present invention without departing from the spirit or scope of the inventions.

For example, the method of controlling a refrigerator and a method of making ice are described as examples. However, the controlling method of the present invention is not limited to the ice-making method but can be applied to rapidly refrigerate or freeze food or containers accommodating other objects. For example, when a container for accommodating an object such as food is disposed in the refrigerator compartment and the tray fan employed in the present invention is installed to the container, the container cannot be utilized for an ice-making use but a rapid refrigerating use.

Although as another example, an example in which the tray fan rotates at low speed when separating ice, the example may be modified such that the rotation speed of the tray fan does not vary or the tray fan stops during the ice-separation.

Although as still another example, an example in which the tray fan always rotates during the operation of the refrigerator, the tray fan may be controlled to stop under a predetermined condition.

Thus, it is intended that the present invention covers the modifications and variations of this invention provided they come within the scope of the appended claims and their equivalents.

What is claimed is:

1. An ice maker comprising:

a compartment;

an ice-making tray disposed in the compartment to receive water and make ice;

a tray fan installed on the ice-making tray to make ambient air within the compartment to pass along a surface of the ice-making tray, the tray fan configured to be driven separately from a cooling fan that supplies air to the compartment; and a plurality of passages provided on the surface of the ice-making tray, to guide air blown by the fan and to receive a heater therein, wherein the passages are arranged in a substantially radial direction from a central portion of the fan to an outer edge of the ice-making tray, and at least a part of at least two adjacent passages of the plurality of passages are bent to increase a path of air passing along the surface of the ice-making tray and at least one arc-shaped protrusion extending past the outer edge of the ice-making tray which permits the heater to form a 'U' shape.

2. The ice maker as claimed in claim 1, wherein the fan is configured to be installed on a bottom surface of the ice-making tray.

3. The ice maker as claimed in claim 1, wherein the fan is configured to make the air flow substantially perpendicular to the surface of the ice-making tray, and the passages arc configured to be arranged such that the air flows substantially parallel to the surface of the ice-making tray.

4. The ice maker as claimed in claim 1, further comprising a plurality of fins extended from the ice-making tray to increase heat-exchange of the ice-making tray with the ambient air.

5. The ice maker as claimed in claim 1, wherein the fan is configured to be driven regardless of conditions of the compartment.

6. The ice maker as claimed in claim 1, wherein a rotation speed of the fan is configured to be varied according to a required ice-making speed or a required quantity of ice.

7. The ice maker as claimed in claim 1, wherein the ice-making tray is configured to rotate to discharge the ice.

8. The ice maker as claimed in claim 4, wherein the fins are configured to be arranged such that neighboring fins form a passage through which air blown by the fan passes.

9. The ice maker as claimed in claim 4, wherein the fins are configured to be arranged such that neighboring fins are arranged from the fan to an edge of the ice-making tray in a radial direction.

10. The ice maker as claimed in claim 8, wherein at least a part of the fins is configured to be bent to prolong a path through which the air passes.

11. The ice maker as claimed in claim 8, wherein the fan is configured to make the air flow substantially perpendicular to the surface of the ice-making tray, and the fins are configured to be arranged such that the air flows substantially parallel to the surface of the ice-making tray.

12. An ice maker comprising:

a compartment;

a cooling fan that supplies chilled air to the compartment;

an ice-making tray disposed in the compartment to receive water and make ice;

a tray fan provided around the ice-making tray to make ambient air within the compartment flow along a surface of the ice-making tray, the tray fan configured to be driven separately from the cooling fan;

a plurality of cooling fins extended from the ice-making tray to increase a heat-exchange capacity of the ice-making tray and to guide air, which is flowed by the tray fan, to flow along the surface of the ice-making tray; and a plurality of passages provided on the surface of the ice-making tray, to guide air blown by the fan and to receive a heater therein, wherein the passages are arranged in a substantially radial direction from a central portion of the fan to an outer edge of the ice-making tray, and at least a part of at least two adjacent passages of the plurality of passages are bent to increase a path of air passing along the surface of the ice-making tray and at least one arc-shaped protrusion extending past the outer edge of the ice-making tray which permits the heater to form a 'U' shape.

13. The ice maker as claimed in claim 12, wherein the tray fan is configured to be mounted on a bottom surface of the ice-making tray.

14. The ice maker as claimed in claim 12, wherein the plurality of cooling fins are configured to be arranged on the surface of the ice-making tray in a radial direction such that air blown by the fan flows along the surface of the ice-making tray in various directions.

15. The ice maker as claimed in claim 12, wherein the tray fan is configured to make the air flow substantially perpendicular to the surface of the ice-making tray, and the cooling fins are configured to be arranged such that the air flows substantially parallel to the surface of the ice-making tray.

16. The ice maker as claimed in claim 12, wherein a rotation speed of the tray fan is configured to be varied according to a required ice-making speed or a required quantity of ice.

17. An ice maker comprising:

a compartment;

an ice-making tray disposed in the compartment to receive and freeze water;

a tray fan installed on a bottom surface of the ice-making tray, the tray fan configured to be driven separately from a cooling fan that supplies air to the compartment;

a plurality of cooling fins extended from the ice-making tray and disposed to guide air, blown by the fan, to an edge of the ice-making tray; and a plurality of passages provided on the surface of the ice-making tray, to guide air blown by the fan and to receive a heater therein, wherein the passages are arranged in a substantially radial direction from a central portion of the fan to an outer edge of the ice-making tray, and at least a part of at least two adjacent passages of the plurality of passages are bent to prolong a path of air passing along the surface of the ice-making tray and lead the air into an arc-shaped protrusion extending past the outer edge of the ice-making tray.

18. A method for making ice comprising:

selectively supplying chilled air by operating a cooling fan to a compartment according to conditions of the compartment;

continuously blowing chilled air by operating a tray fan in the compartment to an ice-making tray disposed in the compartment regardless of the conditions of the compartment, the tray fan provided on the ice-making tray; and distributing blown air along a plurality of passages provided on a surface of the ice-making tray uniformly, to guide air blown by the fan and to receive a heater therein, wherein at least a part of at least two adjacent passages of the plurality of passages are bent to increase a path of air passing along the surface of the ice-making tray and at least one arc-shaped protrusion extending past the outer edge of the ice-making tray which permits the heater to form a 'U' shape.

19. The method for making ice as claimed in claim 18 further comprising: varying a rotational speed of the cooling fan and the tray fan according to a required ice-making speed or a required quantity of ice.

* * * * *